US010226947B2

(12) United States Patent
Hirashima

(10) Patent No.: US 10,226,947 B2
(45) Date of Patent: Mar. 12, 2019

(54) PRINTER AND CONVEYANCE DEVICE

(71) Applicant: SEIKO EPSON CORPORATION, Tokyo (JP)

(72) Inventor: Taku Hirashima, Shenzhen (CN)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/874,573

(22) Filed: Jan. 18, 2018

(65) Prior Publication Data

US 2018/0207959 A1 Jul. 26, 2018

(30) Foreign Application Priority Data

Jan. 20, 2017 (JP) ..... 2017-008093

(51) Int. Cl.

| | |
|---|---|
| ***B41J 11/00*** | (2006.01) |
| ***B41J 3/407*** | (2006.01) |
| ***B41J 2/04*** | (2006.01) |
| ***B41J 2/01*** | (2006.01) |
| ***B41J 11/02*** | (2006.01) |
| ***B41J 11/057*** | (2006.01) |
| ***B41J 13/22*** | (2006.01) |
| ***B41J 11/06*** | (2006.01) |

(52) U.S. Cl.

CPC ..... *B41J 11/0085* (2013.01); *B41J 2/01* (2013.01); *B41J 2/04* (2013.01); *B41J 3/4075* (2013.01); *B41J 11/007* (2013.01); *B41J 11/02* (2013.01); *B41J 11/057* (2013.01); *B41J 11/06* (2013.01); *B41J 13/226* (2013.01)

(58) Field of Classification Search

CPC ..... B41J 2/01; B41J 2/04; B41J 3/4075; B41J 11/007; B41J 11/0085; B41J 11/02; B41J 11/057; B41J 11/06; B41J 13/226

See application file for complete search history.

(56) References Cited

U.S. PATENT DOCUMENTS 6,254,092 B1 * 7/2001 Yraceburu ..... B41J 11/007 271/197
6,554,514 B2 * 4/2003 Wotton ..... B41J 11/002 347/102

(Continued)

FOREIGN PATENT DOCUMENTS

JP 2008-183825 A 8/2008
JP 2009-107768 A 5/2009

(Continued)

*Primary Examiner* — Anh T. N. Vo

(74) *Attorney, Agent, or Firm* — Foley & Lardner LLP

(57) ABSTRACT

A printer includes: an inkjet head configured to eject ink to a medium; a vacuum platen having a platen surface and suction holes, the platen surface extending along a transverse axis that intersects the conveyance direction and that spans across a first side and a second side of the printer, and the suction holes, the suction holes including a first suction hole; and a suction unit configured to produce a negative pressure within the suction holes; the first suction hole comprising a first opening and a second opening, the width of the second opening being less than the width of the first opening, and the first opening having a center along the transverse axis, the second opening having a center along the transverse axis, the center of the second opening being offset to the first side along the transverse axis from the center of the first opening.

20 Claims, 13 Drawing Sheets

(56) References Cited

U.S. PATENT DOCUMENTS

| | | | | |
|---|---|---|---|---|
| 7,101,032 | B2 * | 9/2006 | Ishii | B41J 11/0065 347/104 |
| 7,354,147 | B2 * | 4/2008 | Beehler | B41J 11/0085 347/101 |
| 8,167,307 | B2 * | 5/2012 | Maeyama | B41J 11/0025 271/194 |
| 8,469,478 | B2 * | 6/2013 | Uchiyama | B41J 11/0005 347/16 |

FOREIGN PATENT DOCUMENTS

| | | | |
|---|---|---|---|
| JP | 2010-264624 | A | 11/2010 |
| JP | 2011-148217 | A | 8/2011 |
| JP | 2016-013902 | A | 1/2016 |

* cited by examiner

PRINTER AND CONVEYANCE DEVICE

CROSS-REFERENCE TO RELATED PATENT APPLICATIONS

This application claims priority to and the benefit of Japanese Patent Application No. 2017-008093, filed Jan. 20, 2017, the entire disclosure of which is incorporated herein by reference.

FIELD

The present disclosure relates generally to a printer and a conveyance device.

BACKGROUND

Printers that have an inkjet head for ejecting ink onto a conveyed medium (for example, a continuous paper S), and a vacuum platen (also referred to as a suction panel) having a platen surface on which the medium is placed, and numerous suction holes formed in the platen surface, are known from the literature.

JP-A-2010-264624 described a printer of this type, in which the suction holes are widened toward the platen surface to increase the suction area. JP-A-2010-264624 also describes evening the pressure distribution in the suction holes and improving manufacturability when forming the suction holes by making the suction holes funnel-shaped with the top of the suction holes widened toward the platen surface.

However, if a gap opens between the side edge of the medium and the suction holes in this configuration, this gap and the smallest part of the opening in the suction holes can easily communicate perpendicularly to the platen surface. As a result, sufficient suction is not applied to the medium, and the medium can easily lift away from the platen surface.

More specifically, if the shortest distance between the edge of the wide end of the suction hole along the platen surface and the edge of the smallest opening of the suction hole is value Y, and the size of the gap (formed between the side edge of the medium and the suction holes) is greater than or equal to shortest distance Y, the gap and the smallest opening can communicate in a straight line to the platen surface. As a result, suction from the vacuum platen pulls in air from the outside, and the suction applied to the medium decreases.

SUMMARY

Some embodiments disclosed herein efficiently increase the suction area of suction holes while ensuring sufficient suction on the conveyed medium even if a gap opens between the side edge of the conveyed medium and the suction holes.

Accordingly, a printer according to one embodiment includes: an inkjet head configured to eject ink to a medium that is conveyed in a conveyance direction; a vacuum platen having a platen surface and suction holes, the platen surface being configured to support the medium while the medium is conveyed in the conveyance direction, the platen surface extending along a transverse axis that intersects the conveyance direction and that spans across a first side and a second side of the printer, and the suction holes extending through the platen surface, the suction holes including a first suction hole; and a suction unit configured to produce a negative pressure within the suction holes; the first suction hole comprising a first opening and a second opening, the first opening having a width along the transverse axis, the second opening having a width along the transverse axis, the width of the second opening being less than the width of the first opening, and the first opening having a center along the transverse axis, the second opening having a center along the transverse axis, the center of the second opening being offset to the first side along the transverse axis from the center of the first opening.

This configuration efficiently expands the suction area of the suction holes and ensures sufficient suction is applied to the conveyed medium even if a gap is formed between the side edge of the conveyed medium and the suction holes.

According to various embodiments, the suction holes include first suction holes and second suction holes. The second suction holes are separated from the first suction holes by a gap along the transverse axis.

This configuration can reduce the area between adjacent suction holes where suction is not produced.

Various embodiments preferably also have a shutter configured to close the first suction holes. The first suction holes and second suction holes each comprise the first opening and the second opening. The platen surface extends along the transverse axis between a first side and a second side. A distance between the center of the second opening and the first side along the transverse axis is smaller than a distance between the center of the first opening and the first side along the transverse axis, and a distance between the center of the fourth opening and the first side along the transverse axis is smaller than a distance between the center of the third opening and the first side along the transverse axis.

This configuration reduces the effect of suction from the first suction holes and reduces the possibility of vertical communication through a gap and the second suction holes when the first suction holes are open.

In some embodiments, the first suction holes and the second section holes each comprise the first opening and the second opening. The platen surface extends along the transverse axis between a first side and a second side and a center line of the second openings of the first suction hole is closer along the transverse axis to the first side of the platen surface than a center line of the first openings of the first suction hole. A distance between the center of the second opening and the first side along the transverse axis is smaller than a distance between the center of the first opening and the first side along the transverse axis, and a distance between the center of the fourth opening and the second side along the transverse axis is smaller than a distance between the center of the third opening and the second side along the transverse axis.

This configuration efficiently expands the suction area of the suction holes and ensures that sufficient suction is applied to the conveyed medium even if a gap is formed between the side edge of the conveyed medium and the suction holes.

Various embodiments preferably also have a configuration in which the conveyed medium comprises a first side edge and a second side edge that are opposite side edges of the conveyed medium with respect to the transverse axis. The printer further comprises a guide extending along the conveyance direction of the conveyed medium and configured to contact the first side edge or the second side edge of the conveyed medium.

In this configuration, the position of the other side edge of the conveyed medium changes according to the width of the conveyed medium. As a result, the chance of vertical communication between a gap in the suction holes and the second opening is reduced along the side edge of the conveyed medium that changes along the transverse axis depending on the width of the conveyed medium.

Various embodiments preferably also have a stationary guide extending along the conveyance direction of the conveyed medium and configured to contact the first side edge of the conveyed medium, and an adjustable guide extending along the conveyance direction of the conveyed medium, configured to contact the second side edge of the conveyed medium, and being movable along the transverse axis.

This configuration enables easily loading the conveyed medium while avoiding skewing the conveyed medium.

In various embodiments, the maintenance position of the inkjet head is positioned along one side edge of the conveyed medium.

This configuration avoids the inkjet head from being affected by suction during maintenance.

According to another embodiment, a conveyance device configured to convey a medium in a conveyance direction includes: a vacuum platen having a platen surface and suction holes, the platen surface being configured to support the medium while the medium is conveyed in the conveyance direction, the platen surface extending along a transverse axis that intersects the conveyance direction and that spans across a first side and a second side of the printer, and the suction holes extending through the platen surface, the suction holes including a first suction hole; and a suction unit configured to produce a negative pressure within the suction holes; the first suction hole comprising a first opening and a second opening, the first opening having a width along the transverse axis, the second opening having a width along the transverse axis, the width of the second opening being less than the width of the first opening, and the first opening having a center along the transverse axis, the second opening having a center along the transverse axis, the center of the second opening being offset to a first side along the transverse axis from the center of the first opening.

This configuration efficiently expands the suction area of the suction holes and ensures that sufficient suction is applied to the conveyed medium even if a gap is formed between the side edge of the conveyed medium and the suction holes.

Other objects and attainments together with a fuller understanding of the invention will become apparent and appreciated by referring to the following description and claims taken in conjunction with the accompanying drawings.

DETAILED DESCRIPTION

Various embodiment are described below with reference to the accompanying figures.

Embodiment 1

Figure 1:
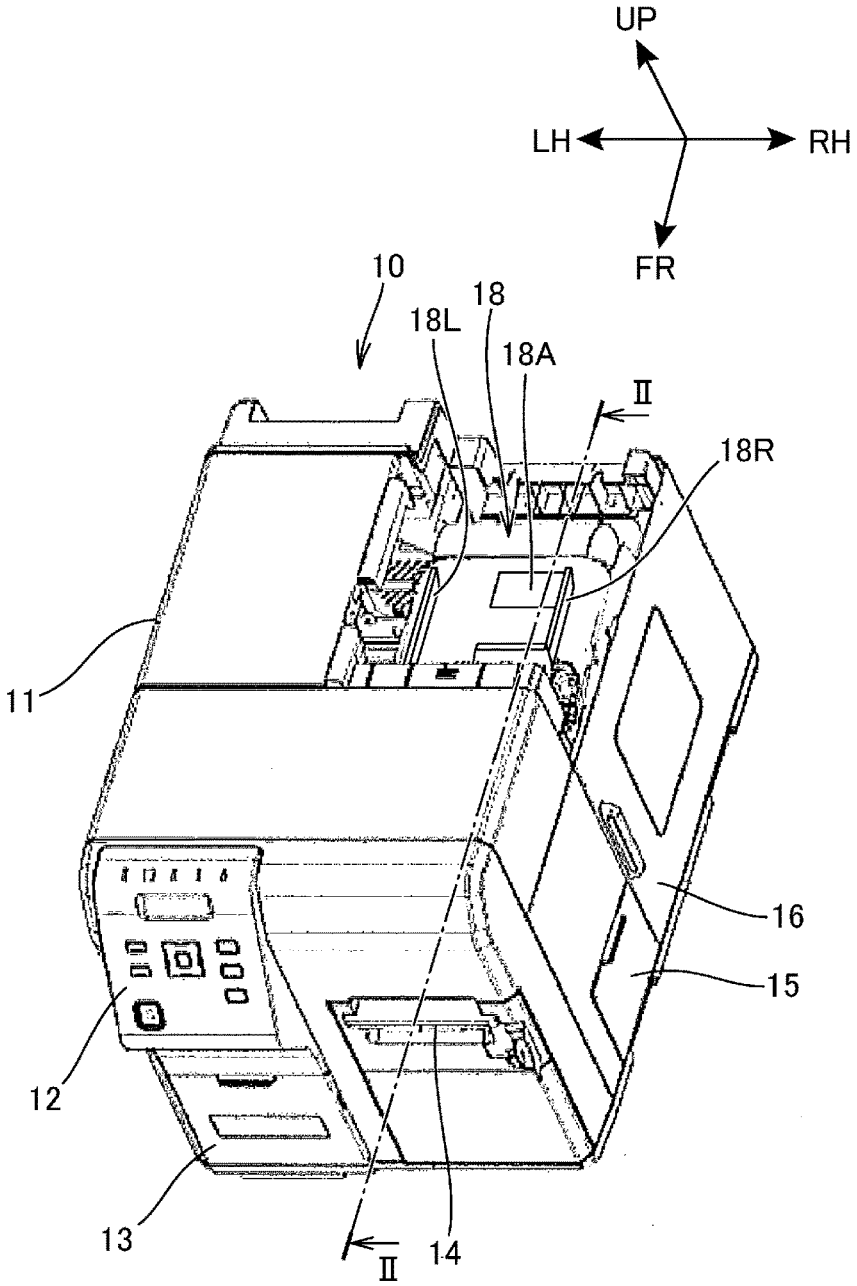
FIG. 1 is a perspective view of a printer according to a first embodiment.

FIG. 1 is a perspective view of a printer 10 according to a first embodiment. The printer 10 is a label printer that prints on a recordable or printable conveyed medium, for example a continuous paper S. The continuous paper S may be, for example, label paper having labels affixed at a regular interval to a continuous liner or backer. However, the continuous paper S is not limited to label paper, and various types of paper may be used. For example, fanfold paper folded at perforations formed at a regular interval in the conveyance direction of the paper may be used as the continuous paper S. This printer 10 connects by wire or wirelessly through a Universal Serial Bus (USB) cable or local area network (LAN) to an information processing device and prints based on print data sent from the information processing device.

In FIG. 1 and other figures, FR indicates the front of the printer 10, LH indicates the left side of the printer 10, RH indicates the right side of the printer 10, and UP indicates the top of the printer 10.

As shown in FIG. 1, the printer 10 has an approximately rectangular case 11 that embodies the housing of the printer 10. An operating panel 12 with operating buttons is provided on the front FR side of the case 11. Below the operating panel 12 is a pull-out type ink cartridge loading opening 13. A slotted paper exit or media exit 14 from which the continuous paper S is discharged after printing is formed in the front FR on the right RH side of the case 11.

A waste ink tank replacement opening 15 is disposed along the right RH side of the case 11 at the bottom toward the front FR side of the case 11, and a roll paper loading opening 16 is disposed along the right RH side of the case 11 toward the back of the case 11 relative to the waste ink tank replacement opening 15. An access cover (not shown) is disposed along the top of the case 11, and opening the access cover exposes a guide assembly 18 disposed to the conveyance path 21 (described below) of the continuous paper S.

Figure 2:
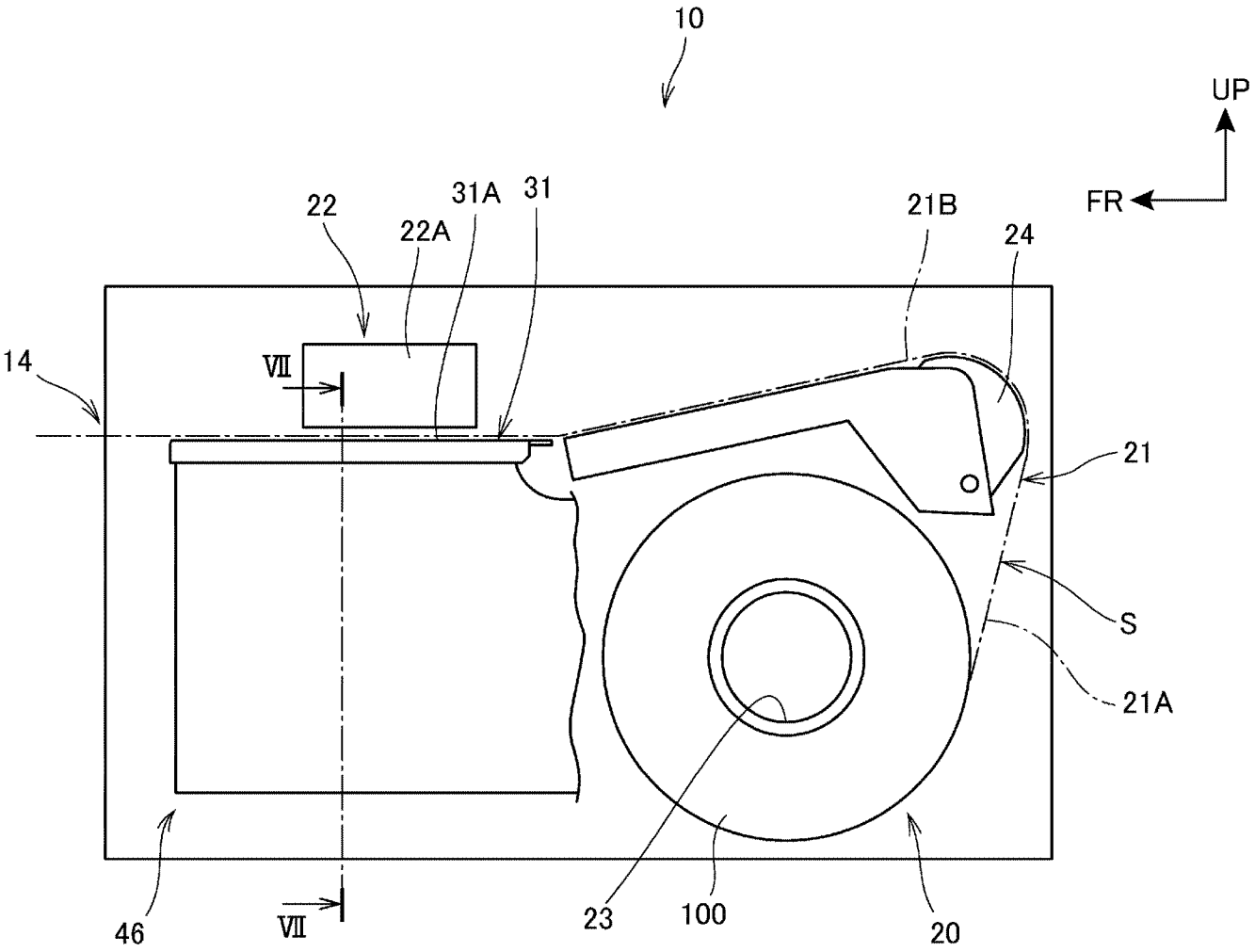
FIG. 2 is a section view through II-II in FIG. 1.

FIG. 2 is a schematic section view of the printer 10 through II-II in FIG. 1. The printer 10 has a roll paper compartment 20 that holds a paper roll 100 of the continuous paper S wound into a roll; a conveyance path 21 from the roll paper compartment 20 to the paper exit 14 in the case 11 along which the continuous paper S is conveyed; and a printing mechanism 22 that prints on the continuous paper S at a specific position along the conveyance path 21.

The media loading unit or roll paper compartment 20 is located inside the case 11. More specifically, the roll paper compartment is positioned at the bottom in the back of the case 11 (where the back of the case is opposite the front FR side of the case 11). The conveyance path 21 includes a first path 21A extending toward the top UP side of the case 11 from the roll paper compartment 20 and a second path 21B extending from the top end of the first path 21A toward the front FR side of the case 11.

A conveyance mechanism comprising multiple rollers and a motor that drives the rollers is disposed along the second path 21B. The conveyance mechanism conveys the continuous paper S from the upstream side of the second path 21B downstream to the paper exit 14. The printer 10 can also convey the continuous paper S in reverse by changing the direction of motor rotation.

The paper roll loaded in the roll paper compartment 20 is turned by a roll paper spindle 23. The conveyance path 21 also has a tension lever 24 that applies constant tension to the continuous paper S. The tension lever 24 reduces the occurrence of slack along the conveyance path 21.

The printer 10 further comprises a guide assembly 18 and a platen unit 46 including a vacuum platen 31 that are each disposed along the second path 21B. The vacuum platen 31 is located along front FR side of the guide assembly 18 on the second path 21B.

The guide assembly 18 functions as a paper guide for the continuous paper S. The guide assembly 18 includes a flat feed plate 18A (as shown in FIG. 1) located vertically below the conveyed continuous paper S, a stationary guide, and an adjustable guide. The stationary guide comprises guide wall 18L and the adjustable guide comprises guide wall 18R. The guide walls 18L, 18R extend from opposite sides of the feed plate 18A along the width of the feed plate 18A, where the width is taken along the direction of the transverse axis X. The transverse axis X is perpendicular to the conveyance direction of the continuous paper S and perpendicular to the vertical direction (i.e., the thickness) of the continuous paper S (where the measurement of the continuous paper S along the transverse axis X (i.e., the width of the continuous paper S) is significantly greater than the measurement of the continuous paper along the vertical direction (i.e., the thickness of the continuous paper S)). The guide wall 18L is on the left LH side (i.e., a first side) of the feed plate 18A, and the guide wall 18R is located on the right RH side (i.e., a second side that is opposite to the first side) of the feed plate 18A.

The stationary guide and the adjustable guide (i.e., the guide walls 18L, 18R, respectively) also extend along the conveyance direction of the continuous paper S, are configured to contact the first side edge and the second side edge, respectively, of the continuous paper S, and guide the position of the first and second side edges of the continuous paper S. The continuous paper S comprises the first and second side edges, which are opposite side edges of the continuous paper S with respect to the transverse axis X, which is perpendicular to the conveyance direction. The first and second side edges of the continuous paper S are configured to extend along the conveyance direction.

The guide wall 18L is part of a fixed or stationary guide, which remains in a stationary position. The other guide wall 18R is part of a movable or adjustable guide that can move relative to the stationary guide wall 18L along the transverse axis X. This configuration enables the user of the printer 10 to easily load various different sizes (i.e., widths) of the continuous paper S by positioning the first side edge of the continuous paper S against the guide wall 18L on the stationary side and then adjusting the position of the other guide wall 18R to be aligned with the second side edge of the continuous paper S by adjusting the position of the adjustable guide to the width of the continuous paper S. In this configuration and according to some embodiments, the first side edge of the continuous paper S that contacts the stationary guide wall 18L is always conveyed at the same position along the transverse axis X (that is perpendicular to the conveyance direction). As a result, skewing of the continuous paper S is avoided by the guide walls 18L, 18R. Furthermore, the first side edge of a continuous paper S with a first width is in the same position along the width of the platen surface 31A as a first side edge of a continuous paper S with a second width (where the first width and the second width are different from each other).

As shown, guides (i.e., the guide walls 18L, 18R) are disposed on both the first and second side edges of the continuous paper S along the transverse axis X in this embodiment, but a configuration having a only one guide (i.e., only one of the guide walls 18L, 18R) on only one of the first or second side edge of the continuous paper S is also conceivable. In this case, the continuous paper S is conveyed with the one of the first or second side edges in contact with the one guide.

The printing mechanism 22 has a fluid ejection head or inkjet head 22A that ejects ink onto the conveyed continuous paper S. By ejecting ink from the ink cartridge, the inkjet head 22A forms, ejects, or prints dots onto the continuous paper S. The various combinations of the dots creates images printed onto the continuous paper S. The inkjet head 22A is disposed to a position opposite the vacuum platen 31 with the second path 21B therebetween. In this embodiment, the inkjet head 22A is vertically above the vacuum platen 31. As a result, the inkjet head 22A ejects ink onto a top surface of the continuous paper S that passing between the inkjet head 22A and the vacuum platen 31.

The printer 10 according to this embodiment is a line printer with the inkjet head 22A having a nozzle row spanning the entire width of the continuous paper S.

The vacuum platen 31 has a platen surface 31A, and the continuous paper S positioned on the platen surface 31A is pulled by suction to the platen surface 31A by the vacuum platen 31, as described below. By conveying the continuous paper S while operating the vacuum platen 31 (i.e., while suctioning the continuous paper S to the platen surface 31A), the printer 10 can convey the continuous paper S while reducing uplift of the continuous paper S away from the platen surface 31A. As a result, a desired platen gap can be maintained between the top surface of the continuous paper S and the inkjet head 22A. The configuration of the vacuum platen 31 is particularly useful when conveying continuous paper S that is wound in a roll because the continuous paper S can otherwise easily separate from the platen surface 31A due to curl in the continuous paper S from the roll.

Figure 3:
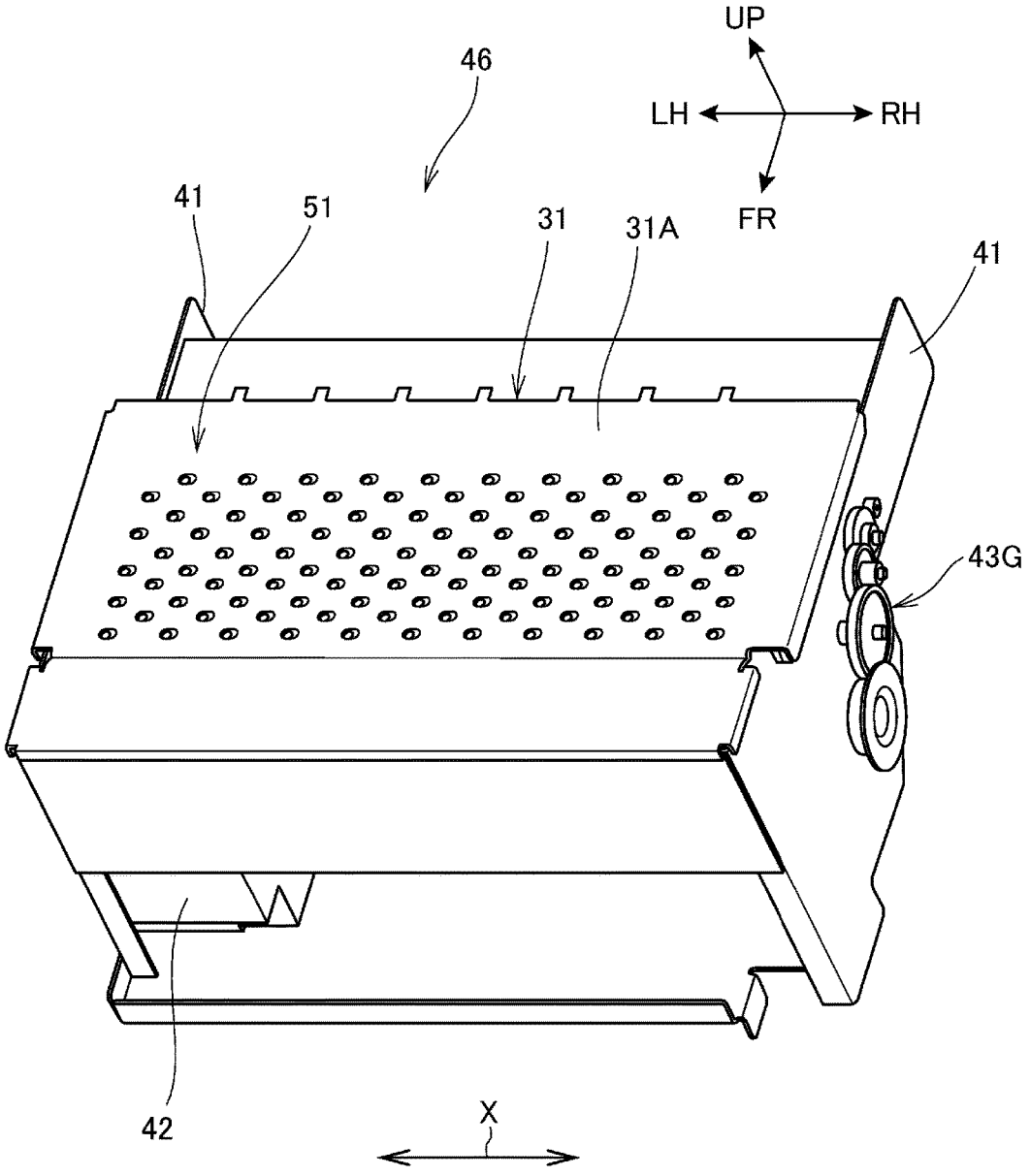
FIG. 3 is a perspective view of the platen unit.
Figure 4:
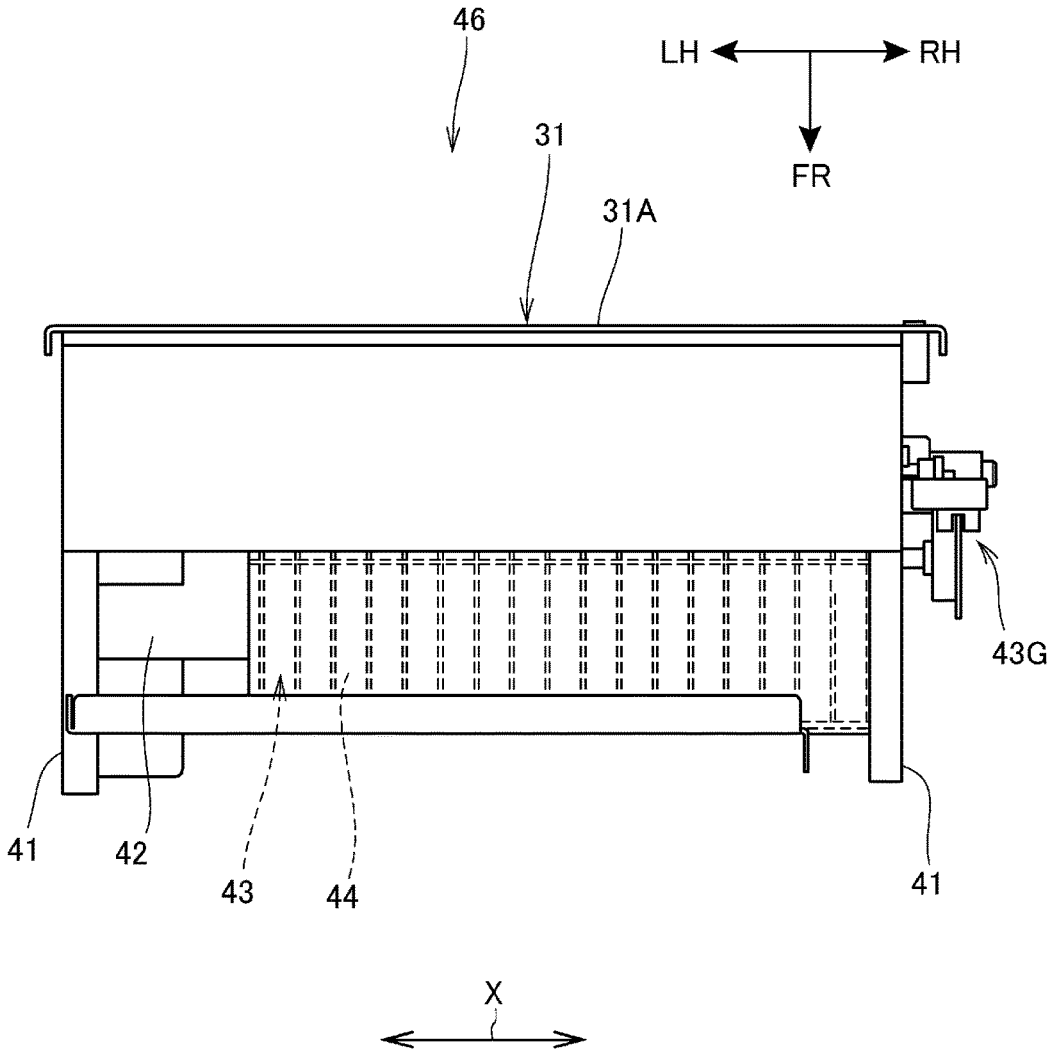
FIG. 4 is a view of the platen unit from the front.

FIG. 3 is a perspective view of the platen unit 46, and FIG. 4 is an front plane view of the platen unit 46 from the front FR. The platen unit 46 includes a vacuum platen 31, a pair of support frames 41, a suction fan 42, a shutter drum unit 43, and a shutter or drum cover 44. The vacuum platen 31 is a flat platen that extends on the transverse axis X, where the transverse axis X is perpendicular to the conveyance direction of the second path 21B. The vacuum platen 31 is supported by the pair of support frames 41 with a gap between the pair of support frames 41 that extends along the transverse axis X.

As shown in FIG. 4, the suction fan 42, a shutter drum 43A of the shutter drum unit 43, and the drum cover 44 are disposed between the pair of support frames 41 on the opposite side of the vacuum platen 31 as the inkjet head 22A (shown in FIG. 2). More specifically, the suction fan 42, the shutter drum 43A, and the drum cover 44 are positioned vertically below the vacuum platen 31, whereas the inkjet head 22A is positioned vertically above the vacuum platen 31. As described below, the suction fan 42 functions as a suction unit that produces suction in the vacuum platen 31.

Figure 5:
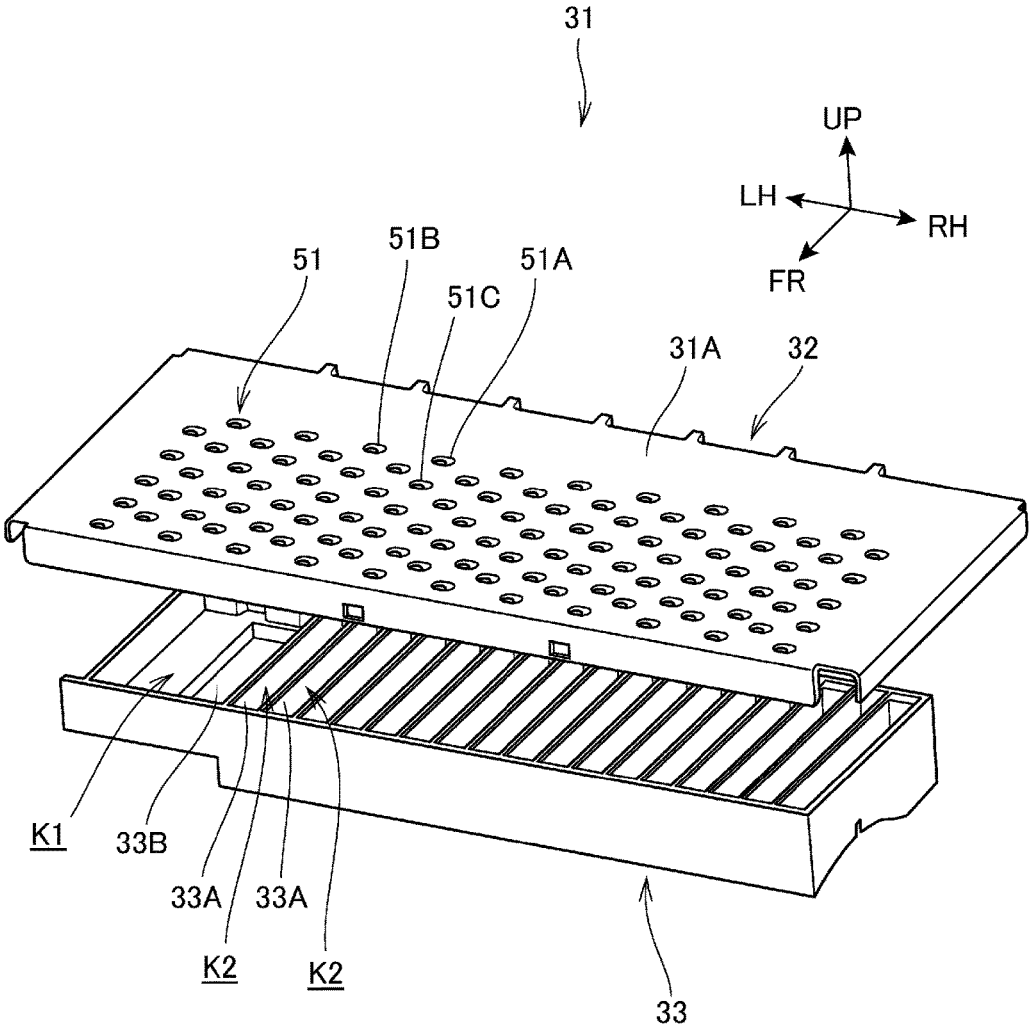
FIG. 5 is an exploded perspective view of the vacuum platen.

FIG. 5 is an exploded perspective view of the vacuum platen 31. The vacuum platen 31 includes a platen 32 with a platen surface 31A on which the continuous paper S is positioned. The vacuum platen 31 further comprises a box 33 that comprises an open side that is covered by the platen 32. The platen 32 extends along the transverse axis X (where the transverse axis X is perpendicular to the conveyance direction of the continuous paper S).

The platen 32 has numerous suction holes 51 that extend completely through the platen surface 31A (and the entire platen 32). The suction holes 51 of the platen 32 include a group of first suction holes 51A and a group of second suction holes 51B that are offset from the first suction holes 51A with a gap between the first suction holes 51A and the second suction holes 51B along the transverse axis X. Accordingly, the second suction holes 51B are separated from the first suction holes 51A by a gap along the transverse axis X and the first suction holes 51A are disposed on the one side of the second suction holes 51B along the transverse axis X. The first suctions holes 51A and the second suction holes 51B may be in the same position or aligned with each other along the conveyance direction. In this embodiment, the first suction holes 51A are positioned on or closer to the right RH side of the second suction holes 51B.

The platen 32 also has third suction holes 51C at the same position or aligned with the first suction holes 51A along the transverse axis X, but with a gap between the first suction holes 51A and the third suction holes 51C in the conveyance direction of the continuous paper S. As described further below, each of the first suction holes 51A, the second suction holes 51B, and the third suction holes 51C communicate with one of multiple suction chambers K2.

Figure 6:
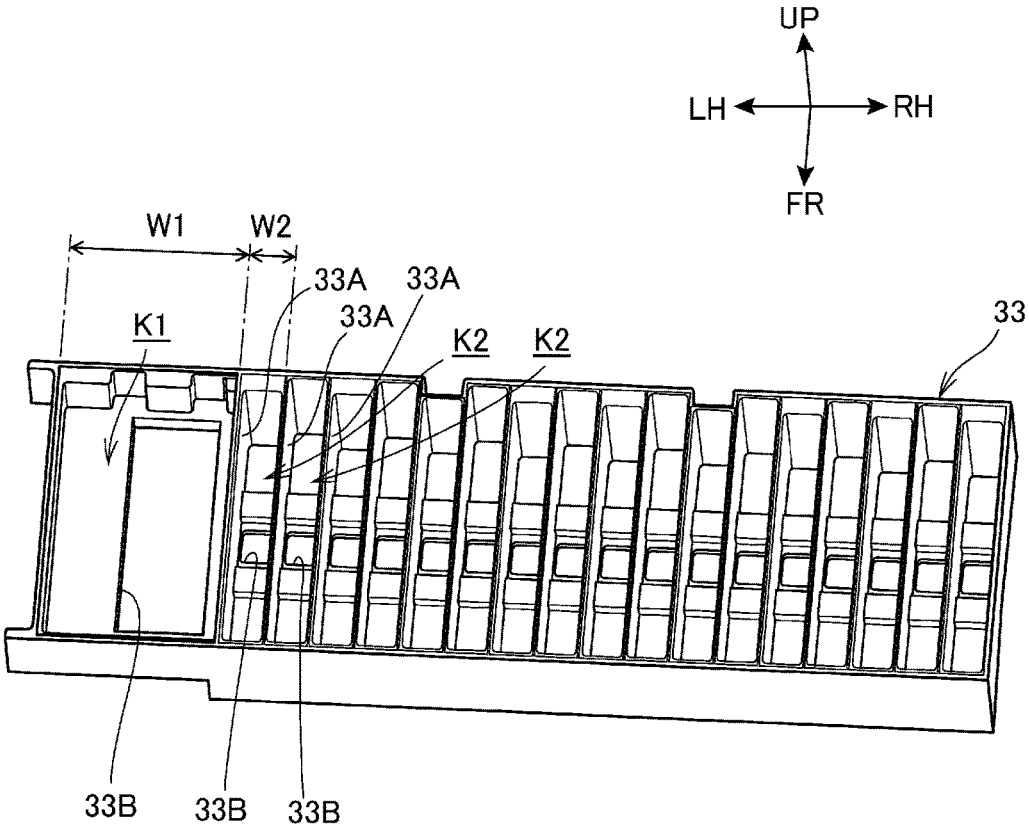
FIG. 6 is a perspective view of the vacuum platen box.

FIG. 6 is a perspective view of the box 33. As shown in FIG. 5 and FIG. 6, the box 33 has multiple dividers 33A disposed with a gap therebetween across the width (taken along the transverse axis X) of the continuous paper S and dividing the space between the bottom of the box 33 and the lower surface of the platen 32 into multiple chambers. The bottom of the box 33 has through-holes 33B that provide fluid communication to the space within the box 33 that is divided by the dividers 33A.

In this configuration, air in the spaces formed by the dividers 33A within the box 33 is suctioned by the suction fan 42 through the through-holes 33B. As a result, the spaces divided by the dividers 33A function as suction chambers. More specifically, the suction chambers are negative pressure chambers in which the pressure is lower than atmospheric pressure. By communicating through the suction chambers, the suction fan 42 produces a negative pressure in each of the suction holes 51, which exerts a suction on the continuous paper S.

As shown in FIG. 6, the suction chambers of the box 33 include suction chamber K1 and multiple suction chambers K2 positioned between the suction chamber K1 (at one end of the box 33) and the other end of the box 33.

Between the two guide walls 18L, 18R that are disposed on the opposite sides of the width (taken along the transverse axis X) of the continuous paper S, the suction chamber K1 is positioned closer to the stationary guide wall 18L (on the left LH side) in this first embodiment. As described above, the first side edge of the conveyed continuous paper S that contacts the guide wall 18L (that is part of the stationary guide) is conveyed at the same position along the transverse axis X regardless of the width of the continuous paper S. As a result, even if a continuous paper S with a different width is loaded, the continuous paper S with the different width still passes over the area of the platen 32 that is above suction chamber K1.

In this first embodiment, the suction chamber K1 is shaped according to the area that the narrowest usable continuous paper S would take up along the platen 32. The suction chamber K1 communicates with the suction holes 51 located in this area of the platen 32, and width W1 (taken along the transverse axis X and as shown in FIG. 6) of the suction chamber K1 corresponds to or is equal to the width (also taken along the transverse axis X) of the area of the platen 32 that would be occupied or covered by the narrowest usable continuous paper S. As a result, suction chamber K1 functions as a chamber that produces a negative pressure in the suction holes 51 that are disposed along the area of the plate 32 that the narrowest usable continuous paper S would cover.

In this embodiment, the suction chamber K1 also extends along the conveyance direction of the continuous paper S and communicates with the multiple suction holes 51 formed within the width (taken along the transverse axis X) of the suction chamber K1. As a result, a negative pressure produced through the suction chamber K1 to provide suction in all of the holes 51 in the area of the plate 32 along which the narrowest usable continuous paper S is conveyed.

As shown in FIG. 6, the width W2 of each of the suction chambers K2 (i.e., the measurement of each of the suction chambers K2 along the transverse axis X) corresponds to the gap between adjacent suction holes 51 in the platen 32 along the transverse axis X. More specifically, in this first embodiment, the width W2 of each of the suction chambers K2 is approximately equal to the gap between adjacent suction holes 51 in the platen 32. The multiple suction chambers K2 each function as chambers that produce a negative pressure in specific units of the suction holes 51 that do not communicate with the first suction chamber K1.

In this embodiment, the suction chambers K2 are also shaped such that the suction chambers K2 also extend along the conveyance direction of the continuous paper S and communicate with the multiple respective suction holes 51 formed along the width (taken along the transverse axis X) of that particular suction chamber K2. In other words, the first suction holes 51A and the third suction holes 51C communicate with the same suction chamber K2 since they are aligned along the conveyance direction. As a result, negative pressure is produced in each of the suction holes 51 that fluidly communicate with a particular suction chamber K2 at the same position along the transverse axis X.

In this first embodiment, the width W2 of each of the suction chambers K2 is approximately equal to the gap between adjacent suction holes 51 and a negative pressure is produced (from the particular suction chamber K2) in each of the suction holes 51 that is at the same position along the transverse axis X. However, in other embodiments, the relative size between the width W2 and the gap between suction holes 51 may be different. For example, if the width W2 is equal to twice the gap between suction holes 51, a single suction chamber K2 provides negative pressure to twice the area of the platen 32 (and thus to twice the number of suction holes 51), and the configuration of the box 33 and control related to changing the suctioned area are simplified.

As shown in FIG. 6, the through-holes 33B in the suction chamber K1 are larger than the through-holes 33B in the suction chambers K2. As a result, air from the suction chamber K1 communicating with multiple suction holes 51 can be suctioned more quickly than air from the suction chambers K2, and negative pressure can be more easily produced in the many suction holes 51 that communicate with the suction chamber K1.

The through-holes 33B of the suction chambers K2 are disposed in the center of the suction chambers K2 along the conveyance direction. This facilitates producing appropriate negative pressure in multiple suction holes 51 arrayed in the conveyance direction.

Figure 7:
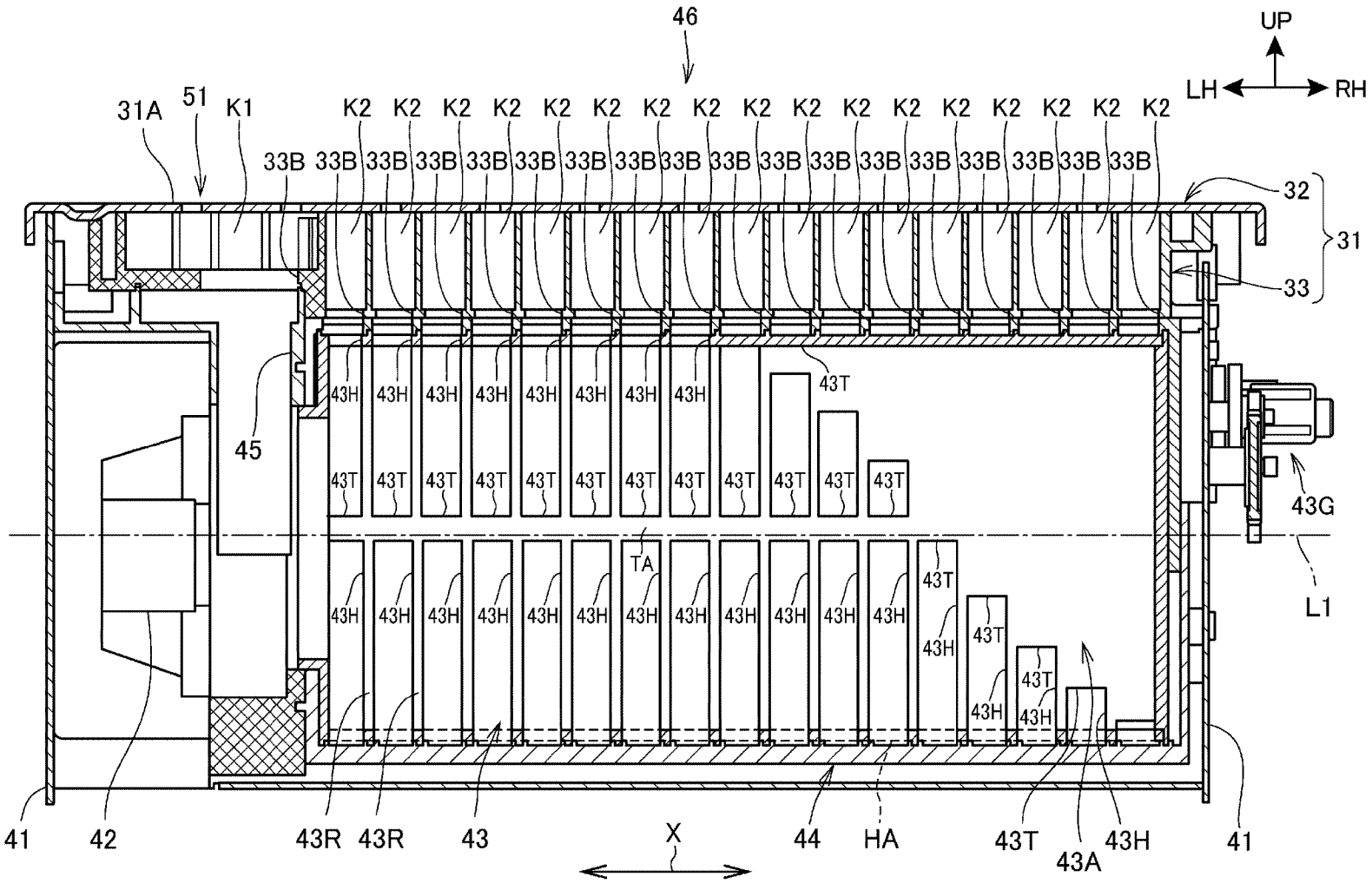
FIG. 7 is a section view of the platen unit in FIG. 2 through VII-VII.

FIG. 7 is a section view of the platen unit 46 through VII-VII in FIG. 2. The shutter drum unit 43 has a shutter drum 43A disposed vertically below the vacuum platen 31 and between the pair of support frames 41. The shutter drum 43A is supported by the pair of support frames 41 freely rotatably on an axis of rotation L1 extending perpendicularly to the conveyance direction of the continuous paper S (and parallel to the transverse axis X). The shutter drum 43A is a hollow cylinder centered on the axis of rotation L1 and extending across the width (taken along the transverse axis X) of the vacuum platen 31. One end of the shutter drum 43A (the end closer to the stationary guide wall 18L in this embodiment) is open. The suction fan 42 is adjacent to the open end of the shutter drum 43A.

The shutter drum 43A is configured to open and close the suction holes 51. Accordingly, circumferentially about the shutter drum 43A at positions corresponding to the through-holes 33B in the suction chambers K2, the shutter drum 43A has openings 43H for opening and allowing communication through the through-holes 33B from within the shutter drum 43A and closed portions 43T for closing and stopping communication through the through-holes 33B from within the shutter drum 43A.

When one of the openings 43H is positioned to align with the through-holes 33B in the suction chambers K2, the inside of the shutter drum 43A and the suction chambers K2 communicate through that through-hole 33B. When one of the closed portions 43T is positioned to align with the through-holes 33B in the suction chambers K2, the opening of that through-hole 33B is closed off by the closed portions 43T from the shutter drum 43A side.

The openings 43H and the closed portions 43T are formed circumferentially about the shutter drum 43A. As a result, when the shutter drum 43A turns on the axis of rotation L1 to a specific rotational position, the shutter drum 43A moves such that either the openings 43H or the closed portions 43T are aligned to each of the specific through-holes 33B. Therefore, by rotating the shutter drum 43A, each of the through-holes 33B can either communicate with the inside of the shutter drum 43A through the openings 43H or cannot communicate with the inside of the shutter drum 43A due to the closed portions 43T closing off the openings to that specific through-holes 33B along the shutter drum 43A side.

As shown in FIG. 7, the closed portions 43T include fully-closed portions TA extending along the same direction as the axis of rotation L1 and spanning both ends of the shutter drum 43A. When the fully-closed portions TA are positioned to be opposite the through-holes 33B (by turning the shutter drum 43A), all of the through-holes 33B communicating with the suction chambers K2 are closed. Furthermore, because the fully-closed portions TA also extend across the width (taken along the transverse axis X) of the shutter drum 43A, the fully-closed portions TA also function as frame members or reinforcing members of the shutter drum 43A.

The openings 43H include a fully-open portion HA extending along the same direction as the axis of rotation L1. Along the fully-open portion HA, the positions corresponding to each of the through-holes 33B in the suction chambers K2 are fully open and allow communication between the through-holes 33B and the inside of the shutter drum 43A (as shown in FIG. 7). As a result, when the fully-open portion HA is positioned opposite the through-holes 33B (by turning the shutter drum 43A), all of the through-holes 33B communicating with the suction chambers K2 can communicate with the inside of the shutter drum 43A.

The shutter drum 43A can rotate to a first angular position where all of the through-holes 33B communicating with the suction chambers K2 are open, and a second angular position where at least one of the through-holes 33B is closed (such as the position shown in FIG. 7).

The shutter drum 43A has curved ribs 43R extending circumferentially. The ribs 43R divide the width (taken along the transverse axis X) of the openings 43H. Because the ribs 43R extend around the full circumference of the shutter drum 43A, the ribs 43R also function as reinforcing members or ribs that reinforce the shutter drum 43A.

The shutter drum unit 43 also has an axle (not shown) protruding from the shutter drum 43A along the axis of rotation L1 and a power transfer mechanism that transfers power to the axle. The power transfer mechanism includes a drive shaft (not shown) driven by power from a drive motor (not shown) and a speed reducer 43G that transfers power between the axle and the drive shaft. Power from the drive motor (not shown) is transferred to the shutter drum 43A, which is driven rotationally. In this embodiment, the axle and the drive shaft are supported by the support frame 41 on the right RH side as shown in FIG. 3. The speed reducer 43G is disposed on the opposite side of the right RH support frame 41 as the shutter drum 43A.

The rotational position or angular position of the shutter drum 43A is adjusted in this printer 10 by a control unit (not shown) that controls rotation or angular displacement of the drive motor. For example, the control unit can detect by a sensor (not shown), or acquire from a driver setting, information related to the width of the continuous paper S and control the rotational position of the shutter drum 43A according to the width.

FIG. 7 shows the shutter drum 43A rotated to a position where the through-holes 33B of the suction chambers K2 from the suction chamber K1 side to the eighth suction chamber K2 are aligned with the openings 43H and are therefore open and can communicate with the inside of the shutter drum 43A. The through-holes 33B of the remaining suction chambers K2 are closed off by the closed portions 43T and cannot communicate with the inside of the shutter drum 43A.

As shown in FIG. 7, the shutter drum 43A in this embodiment is formed so that the starting position of the closed portions 43T shifts further to the right RH side of the axis of rotation L1 each time the shutter drum 43A turns a specific angle of rotation.

Therefore, when the shutter drum 43A turns in a first direction of the circumference of the shutter drum 43A, the number of consecutive through-holes 33B that are open from the suction chamber K1 side (i.e., the left LH side) increases with rotation of the shutter drum 43A. Additionally, when the shutter drum 43A turns in a second direction (which is opposite the first direction), the number of consecutive through-holes 33B that are open from the suction chamber K1 side (i.e., the left LH side) decreases with rotation of the shutter drum 43A.

Figure 8:
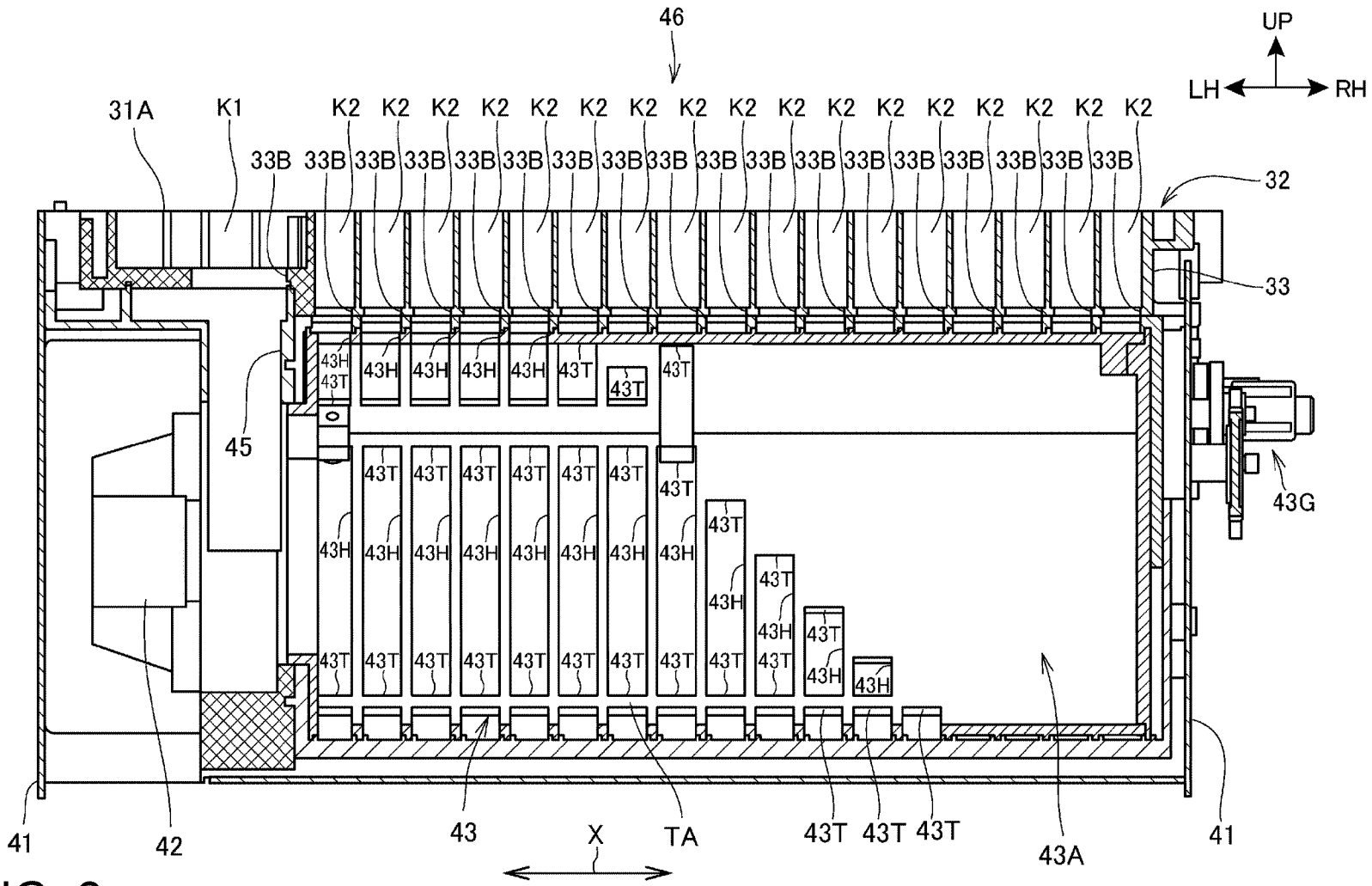
FIG. 8 is a vertical section view of the platen unit when the shutter drum is rotated to a different rotational position that shown in FIG. 7.

FIG. 8 is a vertical section view of the platen unit 46 when the shutter drum 43A turns to a rotational position that is different than the rotational position of the shutter drum 43A shown in FIG. 7. In FIG. 8, the shutter drum 43A has turned in the second direction from the position shown in FIG. 7, and the number of consecutive suction chambers K2 in which the through-holes 33B are open from the suction chamber K1 side changes from 8 to 5.

In other words, the open or closed state of the fluid suction paths that communicate with the first suction holes 51A (through the suction chambers K2 and the through-holes 33B) and the fluid suction paths that communicate with the second suction holes 51B (that are formed a specific distance from the first suction holes 51A along the transverse axis X) can be selectively changed by rotating the shutter drum 43A.

Therefore, the rotational position of the shutter drum 43A can be adjusted according to the specific width of the continuous paper S such that only the suction holes 51 that communicate with the suction chambers K2 in the area of the platen 32 that corresponds to the width of the continuous paper S are open and can communicate with the inside of the shutter drum 43A.

As shown in FIG. 7 and FIG. 8, the through-holes 33B that communicate with the suction chamber K1 communicate with a suction channel 45 that is disposed between the suction fan 42 and the shutter drum 43A. When the suction fan 42 suctions air from inside this suction channel 45, the suction channel 45 goes to negative pressure. As a result, when the suction fan 42 is driven, negative pressure is always produced in the suction holes 51 that communicate with the suction chamber K1, and suction is applied to the continuous paper S along the area of the platen 32 corresponding to the area directly above the suction chamber K1, according to some embodiments.

In alternative embodiments, the suction channel 45 may be omitted. For example, in some embodiments, the shutter drum 43A extends to vertically below the suction chamber K1 and may be configured with openings 43H that always allow the through-holes 33B leading to the suction chamber K1 to be open.

The drum cover 44 is a cover that covers at least part of the shutter drum 43A and has openings in the areas corresponding to the through-holes 33B formed in the bottom of the vacuum platen 31.

As a result of this drum cover 44, the inside of the shutter drum 43A is a space that is closed off from its surroundings and does not communicate with the space outside of the drum cover 44 (and the shutter drum 43A). By opening the area corresponding to the through-holes 33B, the through-holes 33B communicate with the inside of the shutter drum 43A.

The suction fan 42 is disposed between the shutter drum 43A and the support frame 41 (that is closer to the suction chamber K1 side than the suction chambers K2) and vertically below the vacuum platen 31. The suction fan 42 vents inside air from inside the suction channel 45 (that communicates with the suction chamber K1) and the inside of the shutter drum 43A to an area outside of the shutter drum 43A. In other words, the suction fan 42 functions as a suction unit that suctions air from the suction channel 45 and inside the shutter drum 43A and produces a negative pressure within the suction holes 51.

In this configuration, one end of the shutter drum 43A (i.e., the left side in this embodiment) is open, and the suction fan 42 vents air from inside the shutter drum 43A from this end. Therefore, compared with a configuration segmenting the communication path, air from inside the shutter drum 43A can be expelled more efficiently along the axis of rotation L1 of the shutter drum 43A.

In addition, because the suction fan 42 is adjacent to the shutter drum 43A on the axis of rotation L1, the suction fan 42 can be compactly configured. The air path between the shutter drum 43A and suction fan 42 can also be shortened, and air resistance can be decreased. Negative pressure can therefore be efficiently produced inside the shutter drum 43A by the suction fan 42, and operating noise can be reduced.

While a suction fan 42 is used as the suction unit producing negative pressure in the suction holes in this embodiment, a vacuum pump or other mechanism may be used as the suction unit instead of the suction fan 42.

Figure 9:
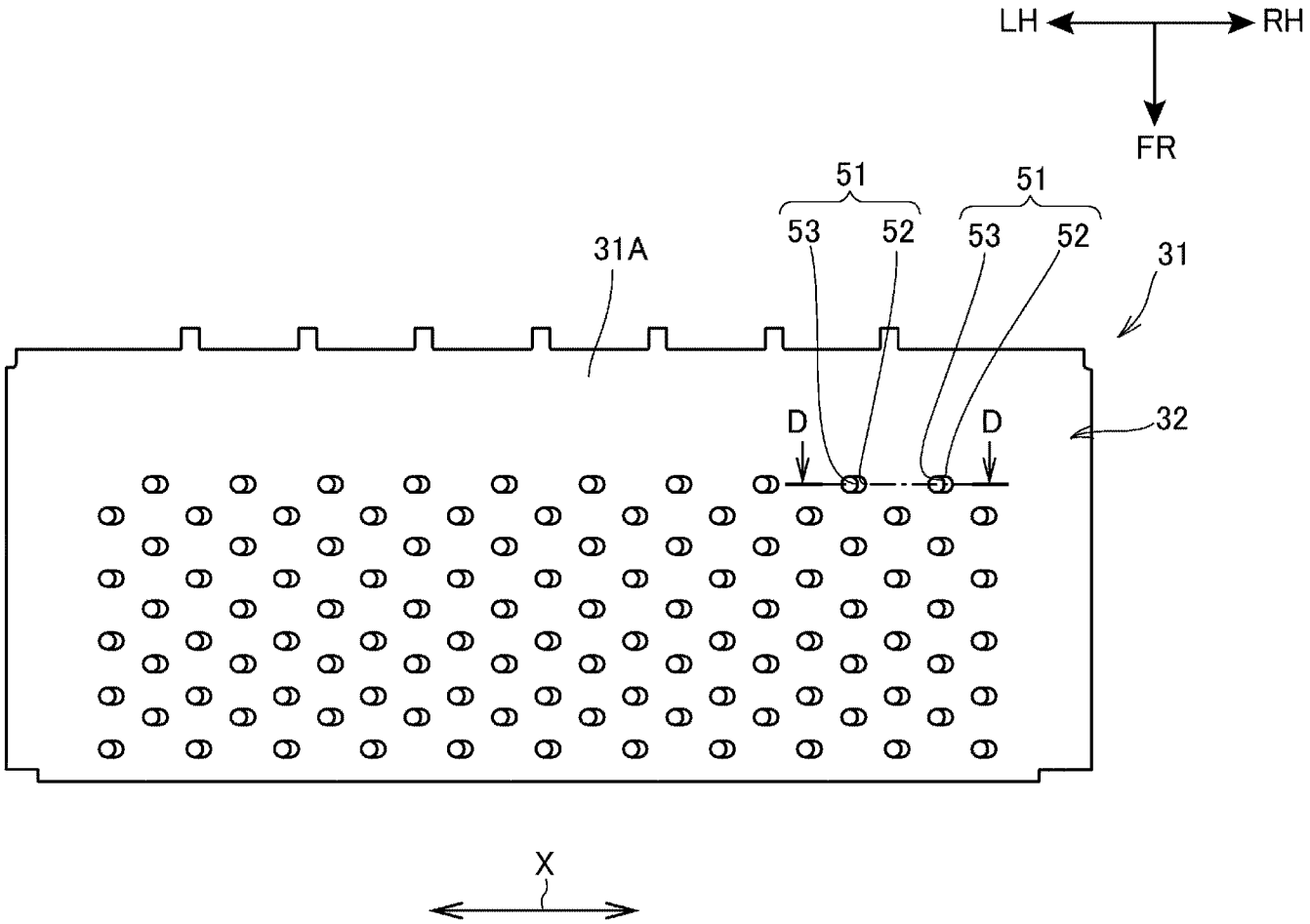
FIG. 9 is a view of the vacuum platen from above.
Figure 10:
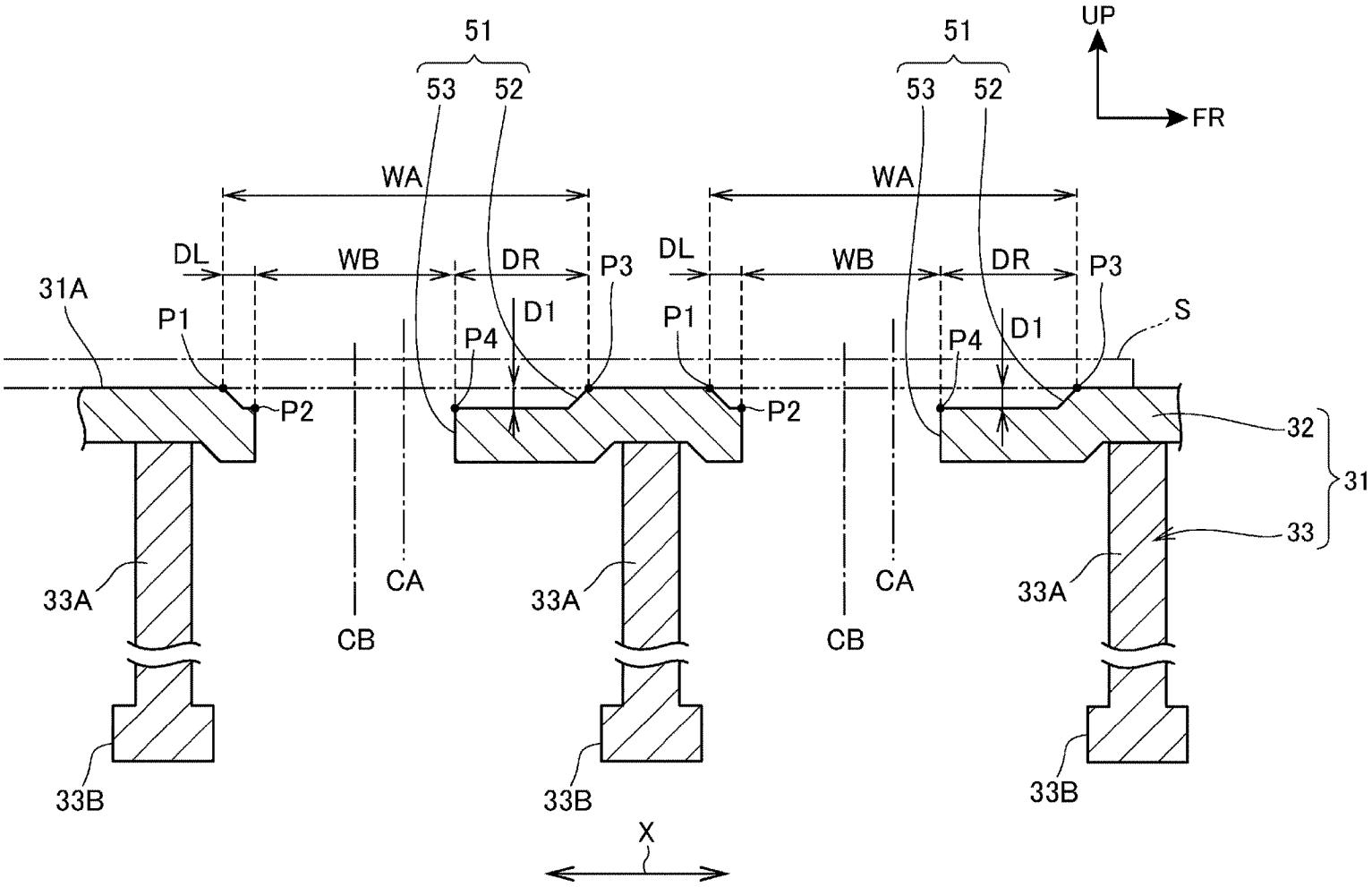
FIG. 10 is a section view through D-D in FIG. 9.

FIG. 9 is a view of the vacuum platen 31 from above. FIG. 10 is a section view through D-D in FIG. 9. As shown in FIG. 9 and FIG. 10, each suction hole 51 is a through-hole passing completely through the platen 32 of the vacuum platen 31.

More specifically, each of the suction holes 51 has a first opening 52 and a second opening 53 that is separated from the platen surface 31A by the first opening 52. The second opening 53 is positioned within the first opening 52. The first opening 52 extends vertically to the edge of the platen surface 31 and accordingly includes a chamfer that extends vertically and a lower surface beneath the chamfer that extends substantially along the transverse axis X (and does not extend vertically). The chamfer allows the first opening 52 to be lower than or recessed vertically relative to the platen surface 31. The platen surface 31A is considered the top-most, outside surface of the platen 32. The second opening 53 includes the smallest opening of the suction hole 51 (i.e., with the smallest diameter), extends completely through the platen 32, and communicates with the first opening 52. The first opening 52 does not extend completely through the platen 32. The width WA of the first opening 52 taken along the transverse axis X across the width of the continuous paper S is greater than the width WB of the second opening 53 taken along the transverse axis X by the sum of distances DR and DL. Accordingly, the width of the second opening 53 taken along the transverse axis X is less than the width of the first opening 52 taken along the transverse axis X.

The number of suction holes 51 in the vacuum platen 31 may be limited to improve the durability of the vacuum platen 31. Accordingly, by including the first opening 52 and the second opening 53 within each of the suction holes 51, the area in which the suction holes 51 can suction the continuous paper S is efficiently increased without sacrificing the durability of the vacuum platen 31. A sufficient suction area required to suction the continuous paper S can therefore be easily ensured as a result of this configuration, and suction is improved. Furthermore, because the suction area of the suction holes 51 is efficiently increased, manufacturing is made easier because the distance between adjacent suction holes 51 can be increased while still ensuring a sufficient suction area.

The openings of the first opening 52 and second opening 53 are round in this first embodiment. However, it should be understood that other embodiments can be constructed with other configurations.

The first and second openings 52, 53 are also manufactured in this embodiment by stamping a metal plate, for example, but, according to alternative embodiments, may be manufactured by methods other than stamping.

The platen surface 31A extends along the transverse axis X spanning across a first side and a second side (where the first side is closest to the first side edge of the continuous paper S). Due to the configuration of the first embodiment, a respective center line CB of the second opening 53 of the first suction hole 51A is closer along the transverse axis X to the first side of the printer 10 than a respective center line CA of the first opening 52 of the first suction hole 51A. And, due to the configuration of the first embodiment, the center CB of the second opening 53 of the second suction hole 51B or a fourth opening, is closer along the transverse axis X to the first side than the center CA of the first opening 52 of the second suction hole 51B or a third opening. More specifically, as shown in FIG. 10, the center CB of the width WB along the transverse axis X of the second opening 53 is offset to one side along the transverse axis X (in this embodiment, offset to the side closer to the stationary guide wall 18L, or left LH side) from the center CA of the width WA along the transverse axis X of the first opening 52. In other words, distance DL, which is the distance along the transverse axis X between the edge P1 of one side of the first opening 52 and the edge P2 on a corresponding side of the second opening 53, is shorter than distance DR, which is the distance along the transverse axis X between the edge P3 on the other side of the first opening 52 and the edge P4 on the other corresponding side of the second opening 53. Each of these sides of the first and second openings 52, 53 refers to opposite ends of the first and second openings 52, 53 along the transverse axis X.

On one side of the transverse axis X (i.e., the left LH side) is the stationary guide that includes the guide wall 18L extending in the conveyance direction of the continuous paper S and contacting the first side edge of the conveyed continuous paper S. Therefore, when a continuous paper S with a different width is loaded, the position of the right RH second side edge of the continuous paper S changes along the transverse axis X (compared to another continuous paper S with a different width).

Figure 11:
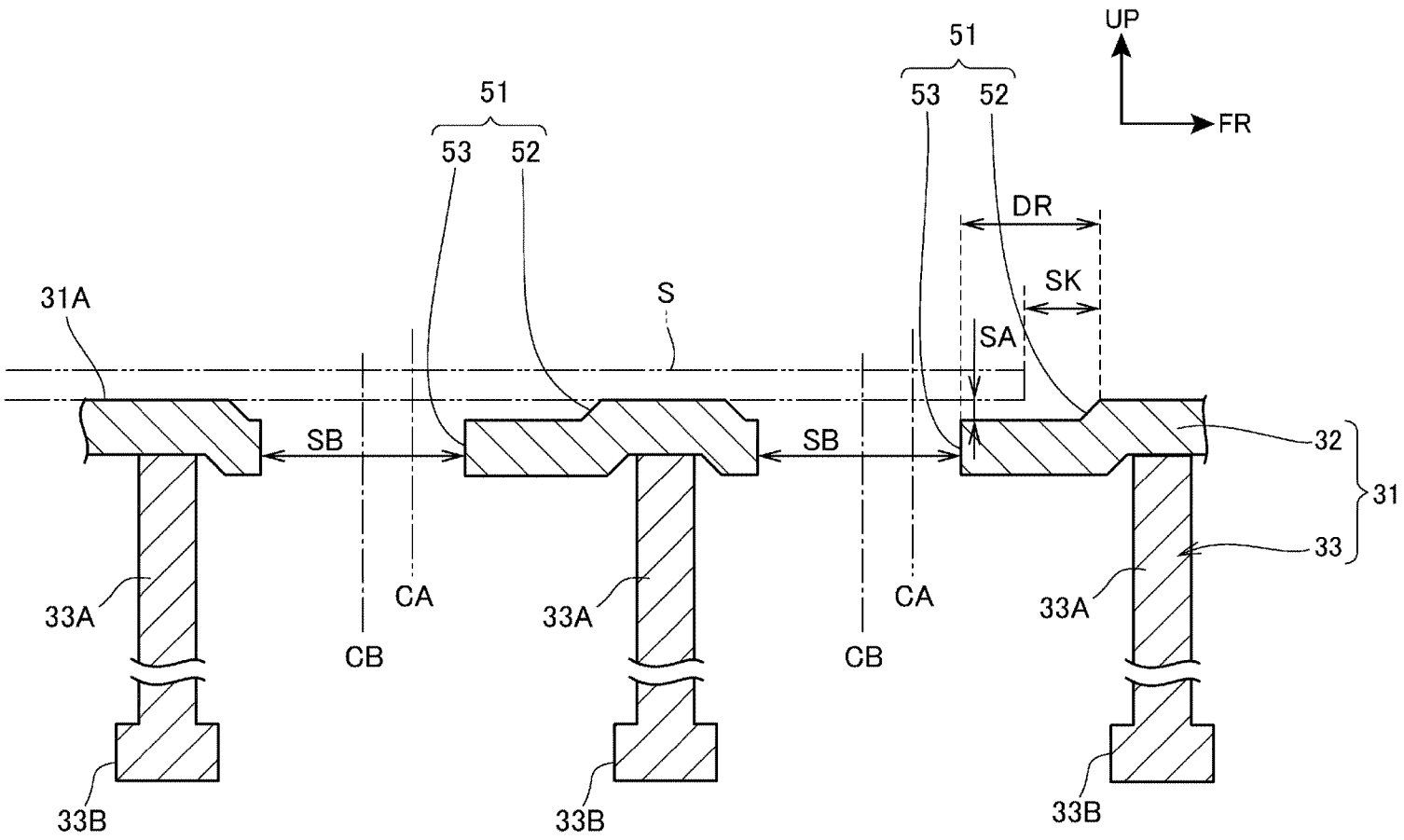
FIG. 11 is a partial section view of the vacuum platen when continuous paper that is narrower than the continuous paper shown in FIG. 10 is on the platen surface.

FIG. 11 illustrates a situation in which a continuous paper S with a narrower width than the continuous paper S shown in FIG. 10 is positioned on the platen surface 31A. In FIG. 10, the right RH second side edge of the continuous paper S is positioned above an area of the platen 32 where there are no suction holes 51. However, depending on the width of the continuous paper S, the right RH second side edge of the continuous paper S may be located above suction holes 51, as shown in FIG. 11. In this case, there is a gap SK between the right-most edge (along the transverse axis X) of the suction holes 51 and the right RH second side edge of the continuous paper S that is not covered by the continuous paper S.

As shown in FIG. 11, the center CB of the width WB of the second opening 53 in this embodiment is closer to one left-most side of the width (taken along the transverse axis X) of the entire suction hole 51 than the center CA of the width WA of the first opening 52. If the length of the gap SK on the transverse axis X is less than distance DR, the gap SK and the second opening 53 do not communicate vertically. Therefore, with the configuration of the suction holes 51 in this embodiment, the chance that the gap SK will communicate vertically with the second opening 53, which is the smallest opening of each of the suction holes 51, is reduced.

Generally speaking, ink droplets are easily affected by the flow of air. Accordingly, air flow through the gap SK increases particularly when the gap SK and the second opening 53 are vertically aligned (and accordingly the gap SK is greater than the distance DR), and the chance that ink droplets ejected from the inkjet head 22A will be affected increases.

Because the second opening 53 is offset=toward the left-most side side of the first opening 52 in this configuration, the distance DR is longer than compared to when the first opening 52 and the second opening 53 are disposed coaxially with the same length along the transverse axis X on either side of the second opening 53. Therefore, the chance that the gap SK and the second opening 53 will communicate vertically is reduced even when a gap SK is formed between the second side edge of the continuous paper S and the suction holes 51.

Because airflow through the gap SK is suppressed even when a gap SK is formed, sufficient suction on the continuous paper S can be more easily ensured. In addition, by ensuring sufficient suction on the continuous paper S, the amount of force used to pull in air from the outside can be reduced, and the effect of a gap SK on ink droplets ejected by the inkjet head 22A can be easily reduced or avoided. It is noted that the distance DR is a length within a range that is able to ensure sufficient suction.

As shown in FIG. 10, the depth D1 is the vertical distance between the platen surface 31A and the lower surface of the first opening 52. The greater the depth D1 of the first opening 52, the greater the open area SA (as shown in FIG. 11) is. The open area SA is the area of the opening of the fluid path between and connecting the gap SK and the second opening 53 when a gap SK is formed. More specifically, the open area SA is the area taken along a cross-section perpendicular to the axial center of the fluid path and is correlated to the depth D1. As this open area SA increases, suction force through the suction holes 51 can more easily suctions outside air or ink. If open area SA increases to the same area as the open area SB of the second opening 53, path resistance decreases and ink is more easily pulled by the force of suction through the suction holes 51. The open area SB is the area of the second opening 53 taken along a cross-section perpendicular to the axial center of the fluid path through the second openings 53.

Therefore, in this configuration, the depth D1 is sized so that the open area SA is less than the open area SB of the second opening 53. As a result, the resistance along the path connecting the second opening 53 and the gap SK increases, which efficiently avoids the ink droplets from being affected by suction.

As described above, the suction holes 51 formed in the vacuum platen 31 in this embodiment are shaped with the second opening 53 (that includes the smallest open part) having a width WB taken along the transverse axis X perpendicular to the conveyance direction of the continuous paper S that is shorter than the width WA of the first opening 52 taken along the transverse axis X at the platen surface 31A. The center CB of the width WB of the second opening 53 is also offset to one side on the transverse axis X from the center CA of the width WA of the first opening 52 in the platen surface 31A.

Thus comprised, the suction area of the suction holes 51 is increased. When a gap SK opens between the second side edge of the continuous paper S and the right-most side (i.e., the edge P3) of the suction holes 51, the possibility of vertical communication between the gap SK and the second opening 53 (which includes smallest open part) is also reduced. The suction area of the suction holes 51 in the vacuum platen 31 is therefore efficiently increased, sufficient suction on the continuous paper S is ensured even if a gap SK is formed, and the effect of suction on ink droplets is reduced.

The suction holes 51 are each formed along the platen 32 with a gap therebetween along the transverse axis X. Because the suction holes 51 are shaped with an expanded suction area along the transverse axis X, the area where suction is not applied between adjacent suction holes 51 is reduced.

This embodiment also has a shutter or shutter drum 43A that closes first suction holes 51A. When continuous paper S is not positioned on the top UP side of the first suction holes 51A, the printer 10 can operate the shutter drum 43A to close the first suction holes 51A. This configuration reduces the effect of suction from suction holes 51 that are not covered by continuous paper S and reduces the possibility of vertical communication between the gap SK and the second openings 53 when the suction holes 51 are open.

The printer 10 also has a stationary guide that includes the guide wall 18L that extends in the conveyance direction of the continuous paper S and contacts the first side edge of the conveyed continuous paper S (i.e., the left LH side). In this configuration, the position of the other second side edge of the continuous paper S changes when the width of the continuous paper S changes. Therefore, on the side of the second side edge that may easy change on the transverse axis X, the chance of vertical communication between the second opening 53 (i.e., the smallest opening) of the suction holes 51 and a gap SK in the suction holes 51 is reduced. Sufficient suction on the continuous paper S can therefore be efficiently ensured even when a gap SK forms, while the avoiding ink droplets from being affected by the suction.

The suction holes 51 are shaped so that, when a gap SK forms between the second side edge of the continuous paper S and the suction holes 51, the open area SA of the path between the gap SK and the second opening 53 is smaller than the open area SB of the second opening 53. Sufficient suction on the continuous paper S can therefore be efficiently ensured even when a gap SK forms, while avoiding the ink droplets from being affected by the suction.

Embodiment 2

A printer 10 according to a second embodiment is the same as the first embodiment except that the second embodiment has a guide assembly 18 that guides the continuous paper S centered on the conveyance path, and some of the suction holes 51 in the vacuum platen 31 are shaped differently. A guide assembly known from the literature may be used as the guide assembly 18 for conveying the continuous paper S centered, and further description thereof is omitted.

Figure 12:
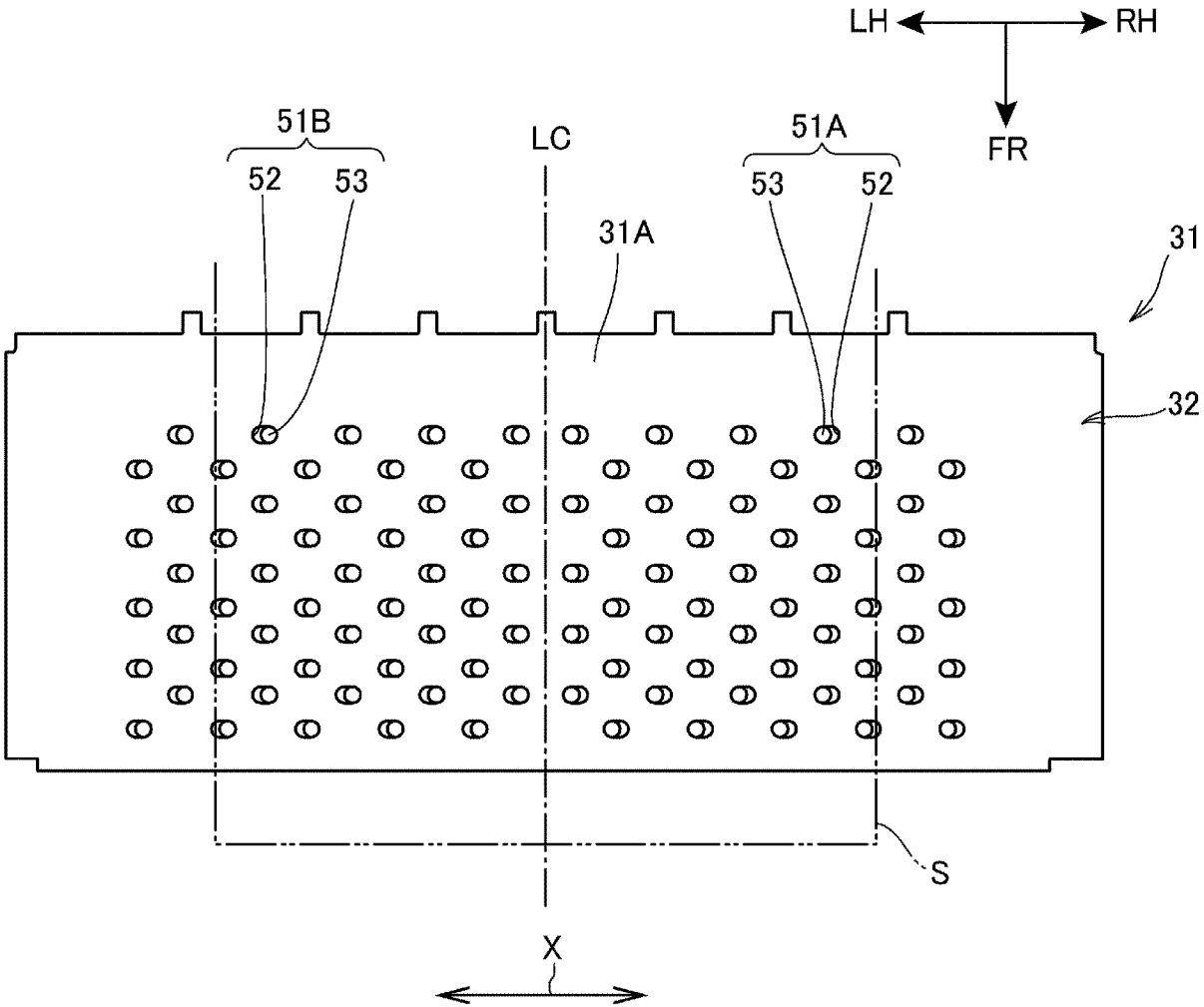
FIG. 12 is a view of the vacuum platen in a printer according to a second embodiment.

FIG. 12 is a top view of the vacuum platen 31 in a printer 10 according to the second embodiment. Because the guide assembly 18 guides the continuous paper S centered on the conveyance path, the center line LC of the continuous paper S being conveyed along the vacuum platen 31 is always the same according to one embodiment. Accordingly, a center line of a continuous paper S with a first width is in the same position along the width of the vacuum platen 31 as a center line of a continuous paper S with a second width (where the first width and the second width are different from each other).

As shown in FIG. 12, the multiple suction holes 51 in the vacuum platen 31 include first suction holes 51A and second suction holes 51B. The first suction holes 51A are on one side (e.g., the right RH side) of the center line LC of the width (taken along the transverse axis X) of the platen surface 31A and the second suction holes 51B are on the other side (e.g., the left LH side) of the center line LC.

Figure 13:
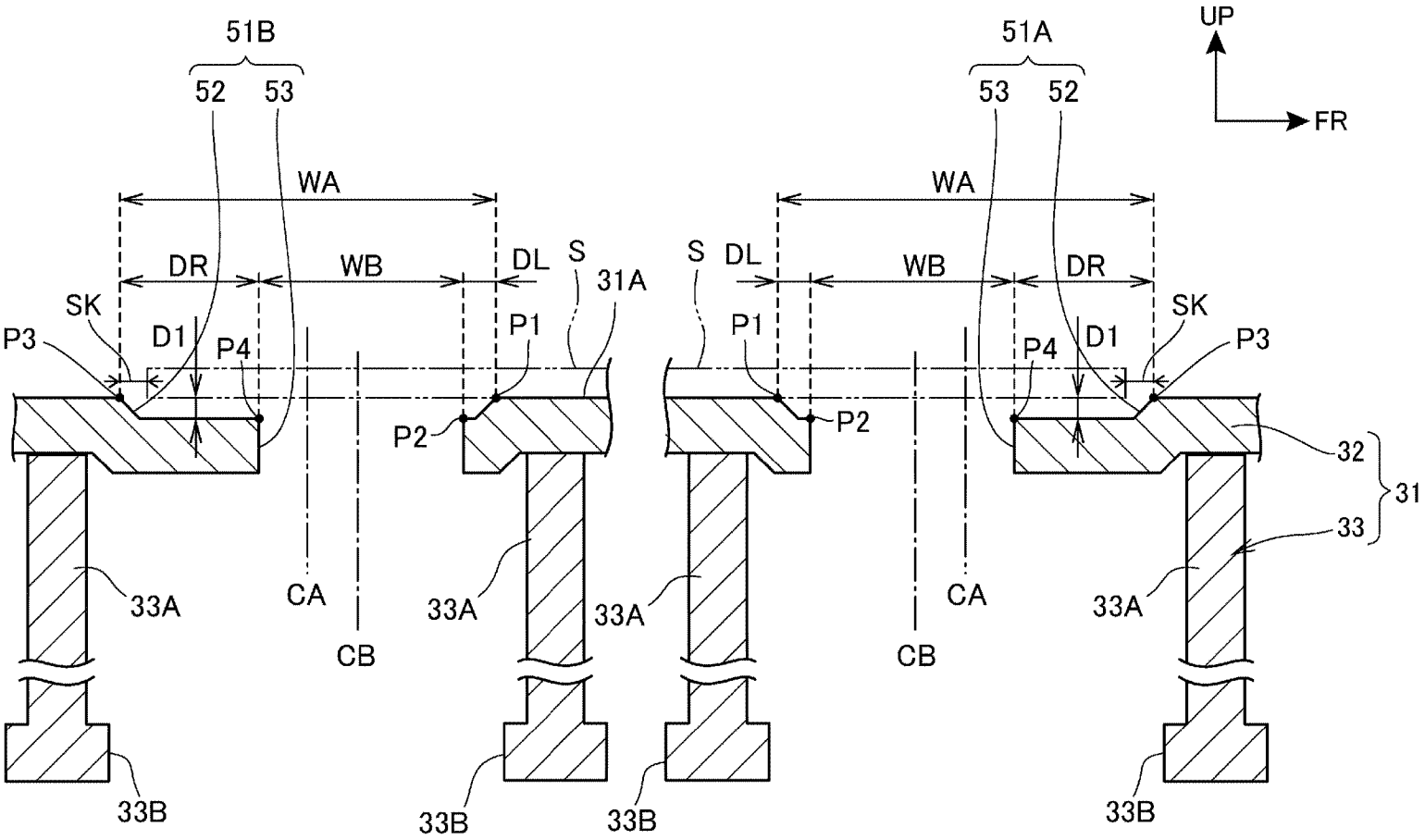
FIG. 13 is a partial section view of the vacuum platen.

FIG. 13 is a partial section view of the vacuum platen 31 and shows the first and second suction holes 51A, 51B in section. The first suction holes 51A are the same as the suction holes 51 in the first embodiment. In other words, the first suction holes 51A are shaped such that the center CB of the width WB of the second opening 53 is offset from the center CA of the width WA of the first opening 52 to one side of the first suction hole 51A along the transverse axis X (i.e., toward the left LH side of the first suction hole 51A).

The second suction holes 51B have a different shape than the first suction holes 51A. More specifically, the second suction holes 51B are shaped such that the center CB of the width WB of the second opening 53 is offset from the center CA of the width WA of the first opening 52 to the other side of the first suction hole 51A along the transverse axis X (i.e., toward the right RH side of the first suction hole 51A).

The platen surface 31A extends along the transverse axis X spanning across a first side and a second side of the printer 10. Due to the configuration of the second embodiment, a center line CB of the second openings 53 of the first suction hole 51A is closer along the transverse axis X to the first side of the platen surface 31A than a center line CA of the first openings 52 of the first suction hole 51A, Additionally, a center line CB of the second openings 53 of the second suction hole 51B is closer along the transverse axis X to the second side of the platen surface 31A than a center line CA of the first openings 52 of the second suction hole 51B.

When the width of the continuous paper S changes in this second embodiment, the positions of both the first and second side edges of the continuous paper S along the platen surface 31A change. Therefore, as shown in FIG. 13, a gap SK can easily result along both the first and second side edges of the continuous paper S.

In the second suction holes 51B in this configuration, the center CB of the second opening 53 is on the other side (i.e., the right RH side) of the center CA of the first opening 52 along the transverse axis X. As a result, as shown in FIG. 13, even if a gap SK is formed in the second suction holes 51B, vertical communication between the gap SK and the second opening 53 can be easily suppressed.

Therefore, vertical communication between the second openings 53 (i.e., the smallest openings) and the gaps SK that can be formed along both the first and second side edges of the continuous paper S can be reduced or avoided by the first suction holes 51A and the second suction holes 51B. Furthermore, sufficient suction on the continuous paper S can be efficiently ensured, while avoiding the ink droplets from being affected by suction.

A printer 10 having suction holes 51 that are desirable when conveying continuous paper S centered on the conveyance path can therefore be provided.

Various preferred embodiments are described, but these embodiments can be varied and adapted in many ways without departing from the scope of the accompanying claims.

For example, the direction in which the suction holes 51 are formed with a gap therebetween and the direction of the axis of rotation L1 of the shutter drum 43A are aligned with the transverse axis X in the embodiments described above. However, it should be understood that other embodiments may be constructed in which these directions are aligned in a specific direction other than along the transverse axis X.

For example, the axis of rotation L1 of the shutter drum 43A may be aligned with the conveyance direction of the continuous paper S to the front FR. In this case, the open or closed state of the suction holes 51 formed with a gap therebetween in the conveyance direction of the continuous paper S (i.e., along the front FR) can be changed by the shutter drum 43A. When the continuous paper S moves in the conveyance direction, for example, this configuration can open only the suction holes 51 in the area covered by the continuous paper S in the conveyance direction and apply suction, in conjunction with movement of the continuous paper S.

The foregoing embodiments are described with reference to a line printer, but the various features of the foregoing embodiments can also be applied to serial printers having an inkjet head 22A disposed movably in a main scanning direction (corresponding to a direction along the transverse axis X) perpendicular to the conveyance direction.

When the printer 10 in the first embodiment is a serial printer, and the inkjet head 22A is maintained by flushing or cleaning, for example, the inkjet head 22A preferably moves to one side (i.e., toward the left) away from the conveyed continuous paper S. This configuration can better avoid the inkjet head 22A from being affected by suction during maintenance. In addition, the distance travelled and the time required for the inkjet head 22A to move from the maintenance position to the reference position for printing set at one side (i.e., the left side) of the continuous paper S can be shortened, and throughput can be improved. The maintenance position of the inkjet head 22A refers to the position in which the inkjet head 22A is positioned along one side edge of the continuous paper S.

The construction and shape of the vacuum platen 31 and guide assembly 18 in the foregoing embodiments can also be changed as desired. For example, except for the suction holes 51, the construction and shape of a vacuum platen known from the literature, such as a vacuum platen having a curved platen surface 31A, can be used for the vacuum platen 31.

The shape of the openings in the suction holes 51 in the foregoing embodiments is also not limited to round or oval, and any desired shape, including polygonal shapes, can be used.

The suction holes 51 are described as comprising a first opening 52 at the platen surface 31A, and a second opening 53 that is the smallest part of the suction hole. However it should be understood that other embodiments could be constructed with a different configuration. For example, in alternate embodiments, the suction holes 51 may be shaped with a combination of three or more openings, and part or all of the suction holes 51 may be a tapered hole.

The foregoing embodiments can be applied to a printer 10 that prints to continuous paper S. However, it should be understood that the various embodiment described herein can be applied to various types of printers, including cut-sheet (slip) printers.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

an inkjet head configured to eject ink to a medium that is conveyed in a conveyance direction;

a vacuum platen having a platen surface and suction holes, the platen surface being configured to support the medium while the medium is conveyed in the conveyance direction, the platen surface extending along a transverse axis that intersects the conveyance direction and that spans across a first side and a second side of the printer, and the suction holes extending through the platen surface, the suction holes including a first suction hole; and a suction unit configured to produce a negative pressure within the suction holes;

the first suction hole comprising a first opening and a second opening, the first opening having a width along the transverse axis, the second opening having a width along the transverse axis, the width of the second opening being less than the width of the first opening, and the first opening having a center along the transverse axis, the second opening having a center along the transverse axis, the center of the second opening being offset to the first side along the transverse axis from the center of the first opening.

2. The printer described in claim 1, wherein:

the suction holes include a second suction hole, the second suction hole being separated from the first suction hole by a gap along the transverse axis.

3. The printer described in claim 2, further comprising:

a shutter configured to close the first suction hole, wherein:

the second suction hole comprises a third opening and a fourth opening, the third opening having a width along the transverse axis, the fourth opening having a width along the transverse axis, the width of the fourth opening being less than the width of the third opening, and the third opening having a center along the transverse axis, the fourth opening having a center along the transverse axis, the center of the fourth opening being offset along the transverse axis from the center of the third opening, a distance between the center of the second opening and the first side along the transverse axis is smaller than a distance between the center of the first opening and the first side along the transverse axis, and a distance between the center of the fourth opening and the first side along the transverse axis is smaller than a distance between the center of the third opening and the first side along the transverse axis.

4. The printer described in claim 2, wherein:

the second suction hole comprises a third opening and a fourth opening, the third opening having a width taken along the transverse axis, the fourth opening having a width taken along the transverse axis, the width of the fourth opening being less than the width of the third opening, and the third opening having a center along the transverse axis, the fourth opening having a center along the transverse axis, the center of the fourth opening being offset along the transverse axis from the center of the third opening, a distance between the center of the second opening and the first side along the transverse axis is smaller than a distance between the center of the first opening and the first side along the transverse axis, and a distance between the center of the fourth opening and the second side along the transverse axis is smaller than a distance between the center of the third opening and the second side along the transverse axis.

5. The printer described in claim 1, wherein:

the first opening is recessed vertically relative to the platen surface and does not extend completely through the platen, and the second opening extends completely through the vacuum platen.

6. The printer described in claim 1, wherein:

the medium comprises a first side edge and a second side edge that are opposite side edges of the medium with respect to the transverse axis, and the printer further comprises a guide extending along the conveyance direction of the medium and configured to contact the first side edge or the second side edge of the medium.

7. The printer described in claim 1, wherein:

the medium comprises a first side edge and a second side edge that are opposite side edges of the medium with respect to the transverse axis, and the printer further comprises:

a stationary guide extending along the conveyance direction of the medium and configured to contact the first side edge of the medium; and an adjustable guide extending along the conveyance direction of the medium and configured to contact the second side edge of the medium, and being movable along the transverse axis.

8. The printer described in claim 1, wherein:

a first side edge of a medium with a first width is in the same position along the transverse axis as a first side edge of a medium with a second width, and the first width and the second width are different.

9. The printer described in claim 1, wherein:

a center of a medium with a first width is in the same position along the transverse axis as a center of a medium with a second width, the first width and the second width are different.

10. The printer described in claim 2, wherein:

the first suction hole is on the first side of a center line of a width of the platen surface along the transverse axis of the platen surface, the second suction hole is on the second side of the center line of the platen surface.

11. The printer described in claim 1, wherein the maintenance position of the inkjet head is positioned on the first side of the medium supported by the platen surface.

12. The printer described in claim 1, wherein the suction unit is one of a suction fan or a vacuum pump.

13. The printer described in claim 1, wherein the suction holes are configured to provide suction such that sufficient suction is applied to the medium even if a gap is formed between a side edge of the medium and the suction holes.

14. A conveyance device configured to convey a medium in a conveyance direction, the conveyance device comprising:

a vacuum platen having a platen surface and suction holes, the platen surface being configured to support the medium while the medium is conveyed in the conveyance direction, the platen surface extending along a transverse axis that intersects the conveyance direction and that spans across a first side and a second side of the printer, and the suction holes extending through the platen surface, the suction holes including a first suction hole; and a suction unit configured to produce a negative pressure within the suction holes;

the first suction hole comprising a first opening and a second opening, the first opening having a width along the transverse axis, the second opening having a width along the transverse axis, the width of the second opening being less than the width of the first opening, and the first opening having a center along the transverse axis, the second opening having a center along the transverse axis, the center of the second opening being offset to a first side along the transverse axis from the center of the first opening.

15. The conveyance device described in claim 14, wherein the suction holes include a second suction hole, the second suction hole being separated from the first suction hole by a gap along the transverse axis.

16. The conveyance device described in claim 15, further comprising:

a shutter configured to close the first suction hole, wherein:

the second suction hole comprises a third opening and a fourth opening, the third opening having a width taken along the transverse axis, the fourth opening having a width taken along the transverse axis, the width of the fourth opening being less than the width of the third opening, and the third opening having a center along the transverse axis, the fourth opening having a center along the transverse axis, the center of the fourth opening being offset along the transverse axis from the center of the third opening, a distance between the center of the second opening and the first side along the transverse axis is smaller than a distance between the center of the first opening and the first side along the transverse axis, and a distance between the center of the fourth opening and the first side along the transverse axis is smaller than a distance between the center of the third opening and the first side along the transverse axis.

17. The conveyance device described in claim 15, wherein:

the second section hole comprises a third opening and a fourth opening, the third opening having a width taken along the transverse axis, the fourth opening having a width taken along the transverse axis, the width of the fourth opening being less than the width of the third opening, and the third opening having a center along the transverse axis, the fourth opening having a center along the transverse axis, the center of the fourth opening being offset along the transverse axis from the center of the third opening, a distance between the center of the second opening and the first side along the transverse axis is smaller than a distance between the center of the first opening and the first side along the transverse axis, and a distance between the center of the fourth opening and the second side along the transverse axis is smaller than a distance between the center of the third opening and the second side along the transverse axis.

18. The conveyance device described in claim 14, wherein:

the first opening is recessed vertically relative to the platen surface and does not extend completely through the platen, and the second opening extends completely through the vacuum platen.

19. The conveyance device described in claim 14, wherein:

the medium comprises a first side edge and a second side edge that are opposite side edges of the medium with respect to the transverse axis, the conveyance device further comprises a guide extending along the conveyance direction of the medium and configured to contact the first side edge or the second side edge of the medium.

20. The conveyance device described in claim 14, wherein:

the medium comprises a first side edge and a second side edge that are opposite side edges of the medium with respect to the transverse axis, and the conveyance device further comprises:

a stationary guide extending along the conveyance direction of the medium and configured to contact the first side edge of the medium, and an adjustable guide extending along the conveyance direction of the medium and configured to contact the second side edge of the medium, and being movable along the transverse axis.

* * * * *